United States Patent [19]

Kelly et al.

[11] Patent Number: 4,989,515

[45] Date of Patent: Feb. 5, 1991

[54] IGNITOR WITH STABLE LOW-ENERGY THERMITE IGNITING SYSTEM

[75] Inventors: Michael D. Kelly, West Alexandria; Alan C. Munger, Miamisburg, both of Ohio

[73] Assignee: The United States of America as represented by the United States Department of Energy, Washington, D.C.

[21] Appl. No.: 390,853

[22] Filed: Aug. 8, 1989

[51] Int. Cl.[5] ..... F42B 3/10

[52] U.S. Cl. ..... 102/202.9; 102/202.5

[58] Field of Search ..... 102/202.5, 202.9

[56] References Cited

U.S. PATENT DOCUMENTS

| | | | |
|---|---|---|---|
| 3,134,329 | 5/1964 | Zeman | 102/28 |
| 3,160,097 | 12/1964 | Colburn, Jr. et al. | 102/28 |
| 3,732,129 | 5/1973 | Martin | 149/2 |
| 4,013,061 | 3/1977 | Trumble et al. | 149/15 |
| 4,354,432 | 10/1982 | Cannavo et al. | 102/202.7 |
| 4,464,989 | 8/1984 | Gibson et al. | 102/202.5 |
| 4,484,960 | 11/1984 | Rucker | 102/202.5 |

*Primary Examiner*—Charles T. Jordan
*Assistant Examiner*—Richard W. Wendtland
*Attorney, Agent, or Firm*—Anne D. Daniel; James H. Chafin; William R. Moser

[57] ABSTRACT

A stable compact low-energy igniting system in an ignitor utilizes two components, an initiating charge and an output charge. The initiating charge is a thermite in ultra-fine powder form compacted to 50–70% of theoretical maximum density and disposed in a cavity of a header of the ignitor adjacent to an electrical ignition device, or bridgewire, mounted in the header cavity. The initiating charge is ignitable by operation of the ignition device in a hot-wire mode. The output charge is a thermite in high-density consoladated form compacted to 90–99% of theoretical maximum density and disposed adjacent to the initiating charge on an opposite end thereof from the electrical ignition device and ignitable by the initiating charge. A sleeve is provided for mounting the output charge to the ignitor header with the initiating charge confined therebewtween in the cavity.

18 Claims, 1 Drawing Sheet

IGNITOR WITH STABLE LOW-ENERGY THERMITE IGNITING SYSTEM

RIGHTS OF THE GOVERNMENT

The U.S. Government has rights in this invention pursuant to Contract No. DE-AC04-76DP00053 awarded by the U.S. Department of Energy to Monsanto Research Corporation.

BACKGROUND OF THE INVENTION

1. Field of the Invention

The present invention relates generally to exothermic materials and, more particularly, is concerned with an ignitor having a stable low-energy thermite igniting system for exothermic materials which are difficult to initiate, such as consolidated thermite and other comparable materials.

2. Description of the Prior Art

Thermite is a mixture of powdered iron oxide, $Fe_2O_3$, and powdered or granular aluminum, Al, or any other metal/metal oxide mixture that reacts exothermically. When it is heated, the following typical reaction occurs:

$$Fe_2O_3 + 2Al \rightarrow Al_2O_3 + 2Fe + 185{,}000 \text{ calories.}$$

This reaction, sometimes called the Goldschmidt reaction, is sufficiently exothermic that maximum temperatures can exceed 4000 degrees F. The iron formed melts and easily ignites any combustible material contacted. Consequently, the reaction is self-sustaining.

The energy requirements to ignite materials such as consolidated thermite are very high, making initiation of the thermite reaction difficult. Traditionally, either a readily ignited chemical heat source or an electrical power source in excess of 100 watts has been used. In an effort to reduce electrical power requirements, "staged" pyrotechnic devices have been devised. These devices use sensitive pyrotechnic mixtures next to an electrical ignition device, commonly a bridgewire, which is the electrical input medium. The drawback with this arrangement is that one or more multi-component pyrotechnic mixtures are required to reach the desired thermal output to ignite the consolidated thermite. The use of several pyrotechnic mixtures raises the issue of compatibility of the chemical entities involved. The use of sensitive materials increases the likelihood that corrosion or desensitizing reactions may occur during storage, making the ignitor useless.

A few representative examples of prior art ignitors are those disclosed in U.S. Pat. Nos. to Zeman (3,134,329), Colburn, Jr. et al (3,160,097), Martin (3,732,129) and Cannavo et al (4,354,432). The devices disclosed by Zeman, Colburn, Jr. et al and Martin are all designed to operate in the exploding bridgewire mode and use secondary high explosives or classical pyrotechnic or propellant mixtures on the bridgewire. The device disclosed by Cannavo et al is designed to operate in a hot-wire mode and contains classical pyrotechnics of many components and binders. In particular, different three-part chemical compositions are used for the "initiator" and "ignitor" portions of the device. The initiator portion is zirconium/lead chromate/silicone resin and the ignitor portion is aluminum/cuprous oxide/nitro polymer.

In view of the aforementioned shortcomings and drawbacks of prior art ignitors, a need still exists for an ignitor of simple construction suitable for igniting materials which are difficult to initiate, such as consolidated thermite and other comparable materials.

SUMMARY OF THE INVENTION

The present invention provides an ignitor with a stable compact low-energy thermite igniting system designed to satisfy the aforementioned needs. The ignitor of the present invention has a stable two-component igniting system which is simple in concept, directly ignitable, and has sufficient energy to be used as a heat source to ignite materials which are difficult to initiate, such as consolidated thermite and other comparable materials. The two-component igniting system uses stable thermite powder which eliminates the concerns of long-term shelf stability and compatibility of the components. The major feature of the present invention is that only the two reactive materials (each being a thermite produced by mixing iron oxide and aluminum powders) are used in the initiator and output sections of the ignitor. Also, the sections are ignited by a hot-wire mode of operation. Before the present invention, thermites have not been ignited by a hot-wire process.

Accordingly, the present invention is directed to an igniting system for use in an ignitor having an electrical ignition device operable in a hot-wire mode. The igniting system comprises: (a) an initiating charge of a thermite in ultra-fine powder form disposable adjacent to the electrical ignition device and ignitable by the ignition device; and (b) an output charge of a thermite in high-density consolidated form disposable adjacent to the initiating charge on an opposite end thereof from the electrical ignition device and ignitable by the initiating charge.

More particularly, the thermite of the initiating charge is a mixture of iron oxide having a particle size of about 0.5 micron and aluminum in a spherical powder form having a particle size of about 1 micron. Further, the thermite of the initiating charge is compacted to 50–70% of theoretical maximum density, and requires an energy of at most 100 millijoules for initiation of ignition thereof by the electrical ignition device in the hot-wire mode.

The thermite of the output charge is a mixture of iron oxide having a particle size of about 0.5 micron and aluminum in a flake form having a particle size of about 3 microns. Also, the thermite of the output charge is compacted to 90–99% of theoretical maximum density, and requires an energy of at least 500 millijoules for initiation of ignition thereof by the initiating charge.

Also, the present invention is directed to the above-defined initiating system in an ignitor having a ground header with a cavity therein and mounting an electrical ignition device in communication with and adjacent to an end of the header cavity. The initiating charge of thermite is disposed in the header cavity adjacent to the electrical ignition device and the output charge of thermite is disposed adjacent to the initiating charge on an opposite end thereof from the cavity and electrical ignition device. Means in the form of a sleeve is used for mounting the output charge to the ground header so as to confine the initiating charge in the cavity.

These and other features and advantages of the present invention will become apparent to those skilled in the art upon a reading of the following detailed description when taken in conjunction with the drawing wherein there is shown and described an illustrative embodiment of the invention.

BRIEF DESCRIPTION OF THE DRAWINGS

In the course of the following detailed description, reference will be made to the attached drawing in which the single FIGURE is a schematic axial sectional view of an ignitor constructed in accordance with the principles of the present invention.

DETAILED DESCRIPTION OF THE INVENTION

Figure 1:
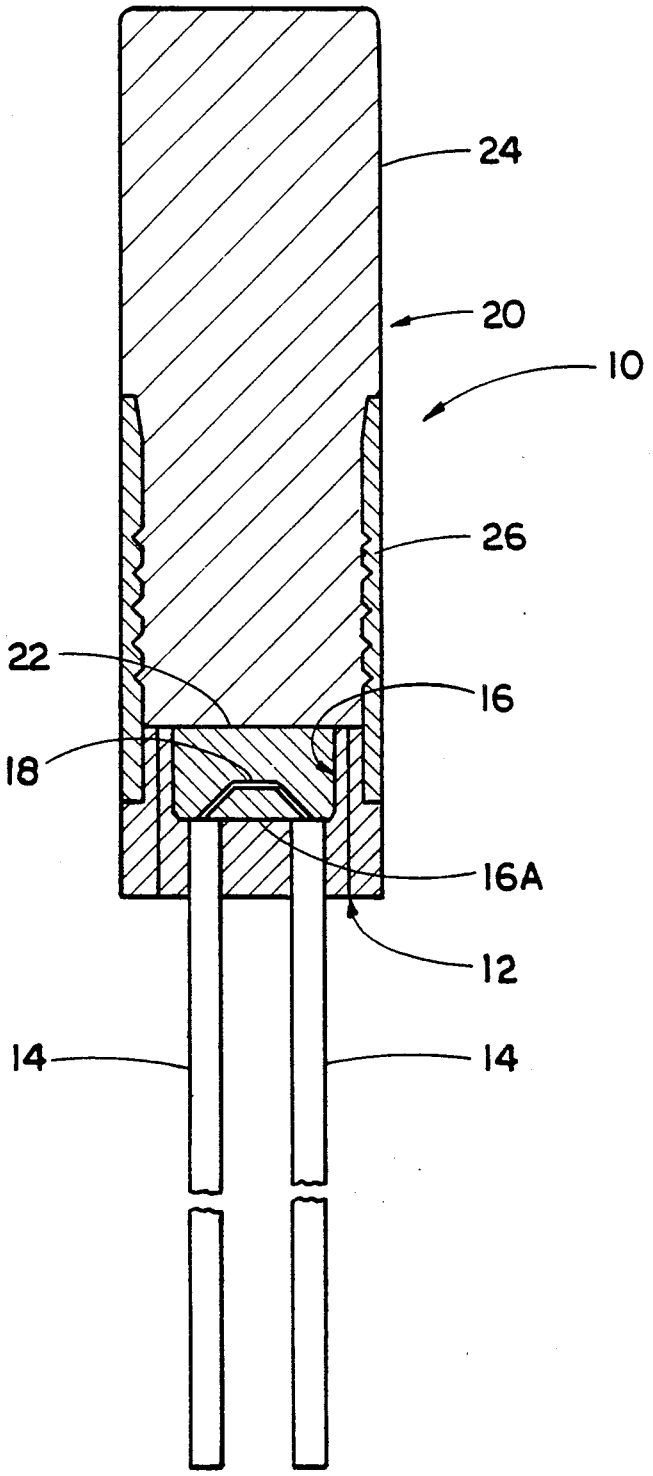

In the following description, like reference characters designate like or corresponding parts throughout the several views. Also in the following description, it is to be understood that such terms as "forward", "rearward", "left", "right", "upper", "lower", and the like, are words of convenience and are not to be construed as limiting terms.

Referring now to the single FIGURE of the drawing, there is shown an ignitor, generally designated 10, constructed in accordance with the present invention. The ignitor 10 includes a cylindrical ground header 12 having a pair of elongated and spaced apart electrodes 14 mounted thereto and extending downwardly therefrom and a cylindrical cavity 16 defined therein, an electrical ignition device 18, in the form of a bridgewire operable in a hot-wire mode, mounted on the bottom end 16A of the cavity 16 and electrically connected to the inner ends of the electrodes 14, and an igniting system of the present invention, generally designated 20.

In accordance with the principles of the present invention, the igniting system 20 is comprised of two cylindrical shaped components, a smaller initiating charge 22 and a larger output charge 24. The initiating charge 22 of the igniting system 20 is thermite (a mixture of iron oxide and aluminum) in ultra-fine powder form compacted preferably to 50–70% of theoretical maximum density and disposed adjacent to the bridgewire 18. The output charge 24 of the igniting system 20 is also thermite in high-density consolidated form compacted preferably to 90–99% of theoretical maximum density and disposed adjacent to the header 12 and the initiating charge 22 in the cavity 16 at an opposite end thereof from the bridgewire 18.

More particularly, the iron oxide in the thermite of the initiating charge 22 has a particle size of about 0.5 micron and the aluminum in the thermite of charge 22 is in a spherical powder form having a particle size of about 1 micron. Further, the compacted thermite powder of the initiating charge 22 requires an energy of at most 100 millijoules for initiation of ignition thereof by the bridgewire 18 in the hot-wire mode.

The iron oxide in the thermite of the output charge 24 has a particle size of about 0.5 micron also, whereas the aluminum is in a flake form having a particle size of about 3 microns. Further, the compacted thermite powder of the output charge 24 requires an energy of at least 500 millijoules for initiation of ignition thereof by the initiating charge 22. This is well within the capability of the charge 22.

As can readily be seen in the single figure of the drawing, the initiating charge 22 of thermite is disposed in the header cavity 12, filling the cavity and extending adjacent to and surrounding the bridgewire 18. The output charge 24 of thermite is disposed adjacent to the initiating charge 22 on an opposite open end of the cavity 16 away from the bridgewire 18.

Finally, the ignitor 10 includes means 26 for mounting the output charge 24 to the ground header 12. The mounting means is preferably a sleeve 26 disposed about the header 12 and output charge 24 so as to encompass adjacent portions thereof and confine the initiating charge 22 therebetween within the header cavity 16.

In summary, the thermite ignitor 10 is a low-energy (about 10-watt) device that uses the parent thermite chemistry (i.e., the same chemical constituents) for the sensitive material next to the bridgewire 18. The compacted density of the ultrafine powder of the initiating charge 22 is preferably matched to the diameter of the bridgewire 18 used in the ignitor 10. One test device used a 0.0019-inch-diameter Tophet C bridgewire with a powder mixture having a compacted density between 1.5 and 2.5 grams per cubic centimeter. The electrical circuit has a resistance of approximately 1 ohm and requires less than 50 millijoules of energy at an applied current of 3.5 amperes to fire the bridgewire 18 in the hot-wire process. This is comparable to the electrical power that can be readily obtained from a 6-volt flashlight battery.

The use of these stable thermite powders in such an ignitor 10 eliminates the concerns of long-term shelf stability and compatibility of the components. Such ignitors have successively ignited hot-pressed, isostatically pressed, as well as plasma-sprayed, thermite structures.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. An igniting system for use in an ignitor having an electrical ignition device operable in a hot-wire mode, said igniting system comprising:

(a) an initiating charge of a thermite in ultra-fine powder form disposable adjacent to the electrical ignition device and ignitable by the ignition device; and (b) an output charge of a thermite in high-density consolidated form disposable adjacent to said initiating charge on an opposite end thereof from the electrical ignition device and ignitable by the initiating charge; and (c) a hot-wire means for direct igniting of said thermite mixtures.

2. The igniting system as recited in claim 1, wherein said thermite of said initiating charge is a mixture of iron oxide having a particle size of about 0.5 micron and aluminum in a spherical powder form having a particle size of about 1 micron.

3. The igniting system as recited in claim 1, wherein said thermite of said initiating charge is compacted to 50–70% of theoretical maximum density.

4. The igniting system as recited in claim 1, wherein said thermite of said initiating charge requires an energy of at most 100 millijoules for initiation of ignition thereof by the electrical ignition device in the hot-wire mode.

5. The igniting system as recited in claim 1, wherein said thermite of said output charge is a mixture of iron oxide having a particle size of about 0.5 micron and aluminum in a flake form having a particle size of about 3 microns.

6. The igniting system as recited in claim 1, wherein said thermite of said output charge is compacted to 90–99% of theoretical maximum density.

7. The igniting system as recited in claim 1, wherein said thermite of said output charge requires an energy of at least 500 millijoules for initiation of ignition thereof by said initiating charge.

8. An igniting system for use in an ignitor having an electrical ignition device operable in a hot-wire mode, said igniting system comprising:

(a) an initiating charge of a thermite in ultra-fine powder form compacted to 50–70% of theoretical maximum density and disposable adjacent to the electrical ignition device and ignitable by the ignition device; and (b) an output charge of a thermite in high-density consolidated form compacted to 90–99% of theoretical maximum density and disposable adjacent to said initiating charge on an opposite end thereof from the electrical ignition device and ignitable by the initiating charge.

9. The igniting system as recited in claim 8, wherein said thermite of said initiating charge requires an energy of at most 100 millijoules for initiation of ignition thereof by the electrical ignition device in the hot-wire mode.

10. The igniting system as recited in claim 9, wherein said thermite of said output charge requires an energy of at least 500 millijoules for initiation of ignition thereof by said initiating charge.

11. The igniting system as recited in claim 8, wherein said thermite of said initiating charge is a mixture of iron oxide having a particle size of about 0.5 micron and aluminum in a spherical powder form having a particle size of about 1 micron.

12. The igniting system as recited in claim 11, wherein said thermite of said output charge is a mixture of iron oxide having a particle size of about 0.5 micron and aluminum in a flake form having a particle size of about 3 microns.

13. In an ignitor having a ground header with a cavity therein and mounting an electrical ignition device in communication with and adjacent to an end of said header cavity, an igniting system comprising:

(a) an initiating charge of a thermite in ultra-fine powder form compacted to 50–70% of theoretical maximum density and being disposed in said header cavity adjacent to said electrical ignition device and ignitable by said ignition device;

(b) an output charge of a thermite in high-density consolidated form compacted to 90–99% of theoretical maximum density and being disposed adjacent to said initiating charge on an opposite end thereof from said electrical ignition device and ignitable by said initiating charge; and (c) means for mounting said output charge to said ground header.

14. The ignitor as recited in claim 13, wherein said thermite of said initiating charge requires an energy of at most 100 millijoules for initiation of ignition thereof by the electrical ignition device in the hot-wire mode.

15. The ignitor as recited in claim 14, wherein said thermite of said output charge requires an energy of at least 500 millijoules for initiation of ignition thereof by said initiating charge.

16. The ignitor as recited in claim 13, wherein said thermite of said initiating charge is a mixture of iron oxide having a particle size of about 0.5 micron and aluminum in a spherical powder form having a particle size of about 1 micron.

17. The ignitor as recited in claim 16, wherein said thermite of said output charge is a mixture of iron oxide having a particle size of about 0.5 micron and aluminum in a flake form having a particle size of about 3 microns.

18. The ignitor as recited in claim 13, wherein said mounting means is a sleeve disposed about said header and output charge so as to encompass adjacent portions thereof and confine said initiating charge therebetween in said header cavity.

* * * * *